US005101136A

United States Patent [19]

Gibilini et al.

[11] Patent Number: 5,101,136

[45] Date of Patent: Mar. 31, 1992

[54] HIGH-EFFICIENCY CATHODOLUMINESCENT SCREEN FOR HIGH-LUMINANCE CATHODE-RAY TUBES

[75] Inventors: Daniel Gibilini, Saint Martin d'Uriage; Bernard Courtan, Grenoble, both of France

[73] Assignee: Thomson Tubes Electroniques, Boulogne Billancourt, France

[21] Appl. No.: 565,680

[22] Filed: Aug. 10, 1990

[30] Foreign Application Priority Data

Aug. 11, 1989 [FR] France ..... 89 10828

[51] Int. Cl.[5] ..... H01J 29/89

[52] U.S. Cl. ..... 313/474

[58] Field of Search ..... 313/474

[56] References Cited

U.S. PATENT DOCUMENTS 4,310,783 1/1982 Temple et al. ..... 313/474
4,310,784 1/1982 Anthon et al. ..... 313/474
4,633,131 12/1986 Khurgin ..... 313/474
4,634,926 1/1987 Vriens et al. ..... 313/474

FOREIGN PATENT DOCUMENTS 0018666 11/1980 European Pat. Off. .
0018667 11/1980 European Pat. Off. .
0012650 1/1985 Japan ..... 313/474

OTHER PUBLICATIONS

Patent Abstracts of Japan, vol. 6, No. 64 (E-103)[942], Apr. 23, 1982; & JP-A-57 7048 (Tokyo Shibaura Denki K.K.) 1-14-1982.

*Primary Examiner*—Palmer C. DeMeo
*Attorney, Agent, or Firm*—Oblon, Spivak, McClelland, Maier & Neustadt

[57] ABSTRACT

A high-efficiency cathodoluminescent screen for high-luminance cathode-ray tubes has a design which makes possible a considerable improvement of the luminance. The cathodoluminescent screen of the invention includes a glass substrate (11) carrying a luminescent screen (12) consisting of luminophor grains. According to a characteristic of the invention, an intermediate screen (15) is inserted between luminescent screen (12) and substrate (11), with the intermediate screen (15) having a refraction index n1 which is clearly greater than refraction index n0 of substrate (11). As a result of this arrangement, a considerable part of the light which penetrates intermediate layer (15) is reflected in the direction of luminescent layer (12), so that this light can then be rediffused to substrate (11), i.e., to use, with an emission indicatrix which is much more greatly concentrated on the axis than in the prior art.

12 Claims, 3 Drawing Sheets

HIGH-EFFICIENCY CATHODOLUMINESCENT SCREEN FOR HIGH-LUMINANCE CATHODE-RAY TUBES

BACKGROUND OF THE INVENTION

1. Field of the Invention

This invention relates to a cathodoluminescent screen for cathode-ray tubes and particularly for high-luminance tubes, such as, for example, the so-called "projection" type tubes.

2. Discussion of the Background

In a cathode-ray tube, the cathodoluminescent screen generally comprises a glass envelope used as a substrate, on which is produced at least one luminescent layer which most often consists of luminophor grains. The cathode-ray tube contains an electron source which makes it possible to produce a beam, which is accelerated and focused before bombarding the luminophor layer. Under the effect of this bombardment, the luminophors emit light, and a light image can be formed on the surface of the screen by deflecting the beam.

The resolution of the image depends in particular on focusing the beam, but it also depends on the characteristics of the cathodoluminescent screen, this screen also having effects on the light efficiency and the luminance in general.

FIG. 1 partially and diagrammatically shows, by a view in section a standard cathodoluminescent screen for cathode-ray tubes. This screen 1 comprises a glass envelope 2 forming a substrate. Substrate 2 carries a luminescent layer 3 formed for example by multiple luminophor grains L1, L2, . . . , Ln. On luminophor layer 3 is deposited in a standard way, opposite substrate 2, i.e., inside the tube, a layer 4 of an electrically conductive material, of aluminum for example, forming a film which makes it possible, on the one hand, to apply the accelerating potential as well as to drain off the charges, and, on the other hand, to reflect to substrate 2, i.e. to use, the light produced in luminophor layer 3 or the luminescent layer.

In a cathode-ray tube, glass substrate 2 generally has a thickness E on the order of 6 to 7 millimeters, and its refraction index n0 is on the order of 1.5. Under these conditions, the light emitted under the impact of an electron beam (symbolized by an arrow 13) by luminophor layer 3, by a grain L1 for example which is in contact with an inside face 5 of substrate 2, can go out through a face 6 of the latter toward the outside of the tube, only for its part whose angle of incidence (in substrate 2) is less than critical angles $\phi 0$, $\phi 0'$ formed between rays R1, R1' (which represent the limiting refraction) and an axis x perpendicular to the plane of outside face 6 of substrate 2. Thus, for the light emitted from grain L1, which is propagated in the direction of outside face 6 to use and which is not included in critical angles $\phi 0$, $\phi 0'$, this light undergoes a total reflection (as illustrated by ray R1) by which it is reflected to inside face 5 of substrate 2, where it is again reflected to opposite face 6, except if it encounters a luminophor grain in contact with this inside face 5; in the latter case, this light can be rediffused to use as symbolized by arrows RD1, RD2, RD3. This phenomenon, which can be repeated several times, is at the root of the creation of a halo of large dimension which tends to degrade in a significant way the contrast of images, and in another way, the light energy of the central peak, i.e., the light energy emitted along the axis perpendicular to the plane of substrate 2.

A large proportion of the light emitted by luminophor layer 3 goes outside of the tube, i.e., of substrate 2, with angles of incidence such that it is lost for use; this particularly in the application to the projection, where the rays of light going out from substrate 2 are not picked up in a large proportion by the optical means of the projection system.

FIG. 2 illustrates this situation and shows for this purpose the front of a standard cathode-ray tube T comprising a cathodoluminescent screen, such as, for example, screen 1 of FIG. 1, and diagrammatically shows lens 7 of the optical system also with a standard projection device. Under the impact at a point A of electron beam 13, a light is produced of which a part is emitted with an angle of incidence which is equal to or greater than critical angle $\phi 0$, as illustrated by limiting ray R1. This light can undergo multiple reflections or be rediffused to use along rays RD1, RD2, RD3, so that this light which is represented by limiting ray R1 produces the halo.

In the example shown in FIG. 2, the use consists of lens 7 which represents the optical means of a projection system. Lens 7 has an opening 8 centered on an axis 9 of tube T, axis 9 being perpendicular to the plane of screen 1.

The light emitted with an angle of incidence which is less than critical angle $\phi 0$ goes out of tube T, i.e., of substrate 2. Only that portion of this light is picked up for use which passes into opening 8 of lens 7, as illustrated by a useful ray RU which is emitted from point A. The other part of this light is symbolized by a ray RP going out from tube T but which does not pass through opening 8 and which is therefore lost for use, which degrades the light efficiency.

It should further be noted that the rays which are rediffused for further use and picked up by the latter can have a harmful effect, such as, for example, rediffused ray RD2 which, although parallel to axis 9, is rediffused from a point different from point A and tends to destroy the contrast.

SUMMARY OF THE INVENTION

The invention has as its object to show a cathodoluminescent screen designed in a new manner which makes it possible to obtain, from each elementary image point on the screen, an emission indicatrix which is more concentrated on the axis. One of the main objects, int eh scope of the technique of so-called "projection" type tubes, is thus to improve the effeciency of pickup, by the projection optical system, of the light emitted by the tube.

According to the invention, a cathodoluminescent screen for cathode-ray tubes, comprising a substrate having a given thickness and a given refraction index, the substrate carrying a luminescent layer subjected to an electronic bombardment and producing a light under the effect of said bombardment, characterized in that an intermediate layer is placed between the luminescent layer and the substrate, the intermediate layer having, on the one hand, a second thickness which is considerably less than the thickness of the substrate and having, on the other hand, a second refraction index greater than the refraction index of the substrate.

By thus inserting such an intermediate layer, a refringent surface is created at the level of faces in contact with the intermediate layer and with the substrate, a refringent surface which totally reflects the light coming from the luminescent layer when this light arrives with an angle of incidence which is greater than a critical angle $\phi 11$ whose value is deduced from that of the refraction indexes of the substrate and of the intermediate layer. On the other hand, critical angle $\phi 11$ is less than another critical angle $\phi 0$ which causes a total reflection of the light at the interface between the substrate and the air under conditions similar to those which have already been mentioned in the introductory clause to explain the defects of the prior art, which lead to creating a halo of large dimension. Under these conditions, the insertion of the intermediate layer has the effect of rediffusing a very large part of the light, beyond the critical angle of refraction $\phi 11$, to the cathodoluminescent layer, so that this light is retransmitted or rediffused outside of the tube, i.e., to use, with an emission indicatrix which is much more concentrated on the axis.

The redistribution efficiency of the light can be greatly favored by the installing of a compact monolayer of fine grains between the intermediate layer and the luminescent layer or luminophor layer.

The invention constitutes a solution to the problems set forth above, a solution which is particularly advantageous in particular because the invention is simple to use and because as a result it constitutes a low-cost solution making it possible in particular to obtain a maximum gain of luminance, to improve the contrast and to reduce the halo greatly.

BRIEF DESCRIPTION OF THE DRAWINGS

The invention will be understood better with the following description, made by way of nonlimiting example in reference to the accompanying figures of which.

DETAILED DESCRIPTION OF THE PREFERRED EMBODIMENTS

Figure 1:
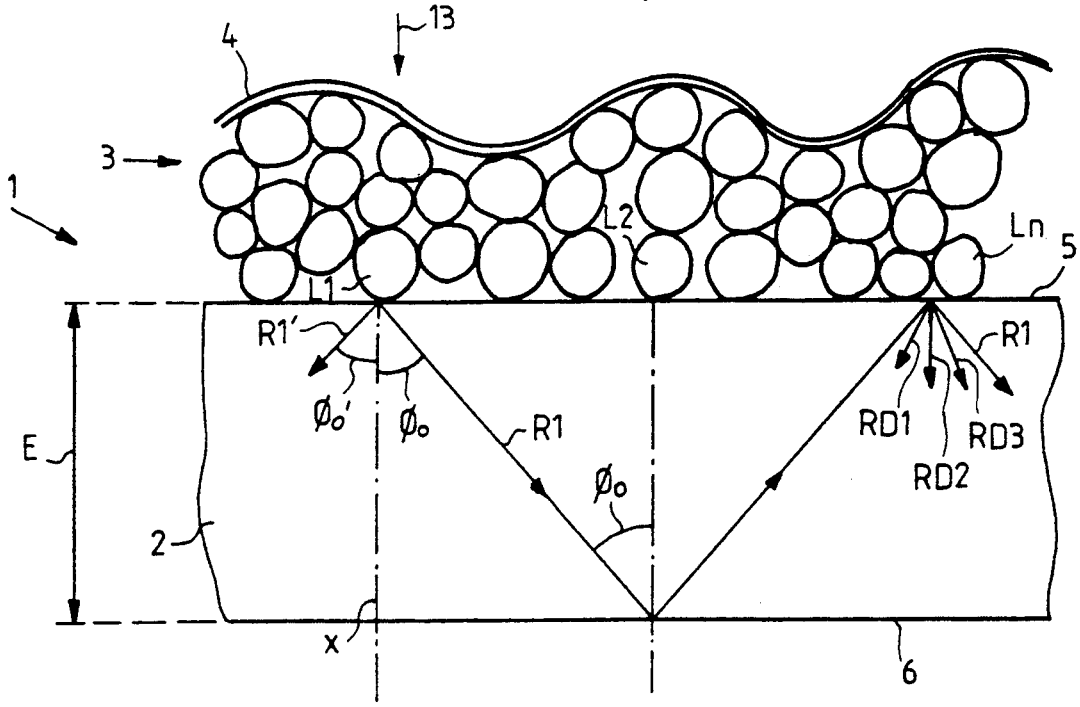
FIG 1 PRIOR ART
FIGS. 1 and 2, already described, show a cathodoluminescent screen of the prior art.
Figure 2:
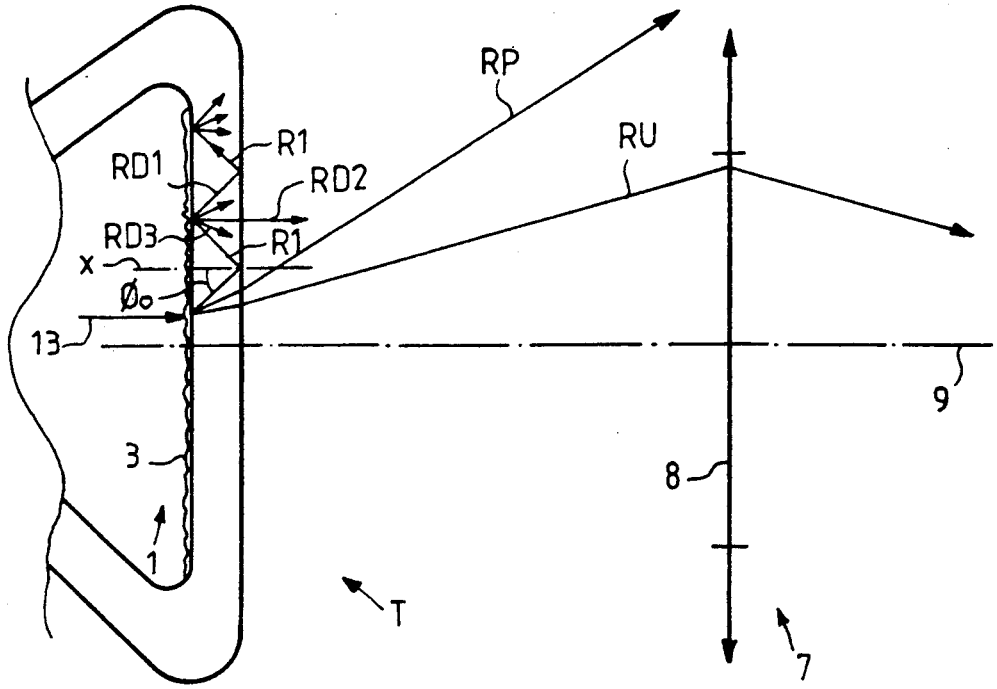
FIG 2 PRIOR ART
Figure 3:
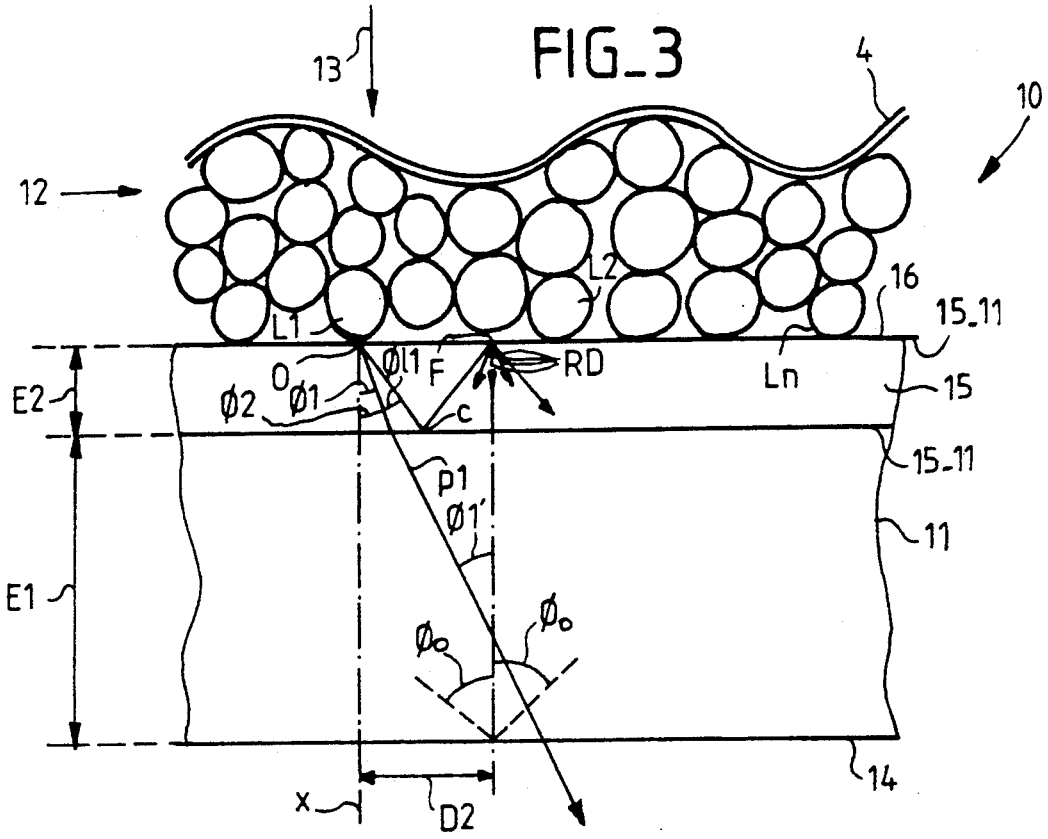
FIG. 3 is a diagrammatic view in section showing a cathodoluminescent screen according to the invention.

FIG. 3 partially shows a cathodoluminescent screen 10 according to the invention, intended to form the screen of a cathode-ray tube. Screen 10 comprises a substrate 11, consisting for example in a standard way of a glass envelope having a thickness $E_1$ on the order of 6 to 7 millimeters. Substrate 11 carries a luminescent layer 12 which is shown with an electron beam symbolized by an arrow 13. In the nonlimiting example of the description, luminescent layer 12 traditionally consists of multiple luminophor grains L1, L2, . . . , Ln. A conductive layer 4, of aluminum, for example, is deposited on luminescent layer 12, to reflect in particular the light produced by luminescent layer 12 to use, i.e., to an outside face 14 of substrate 11, an outside face which is in contact with the air.

According to another characteristic of the invention, an intermediate layer 15 is inserted between luminescent layer 12 and substrate 11. Intermediate layer 15 consists for example of a dielectric material, transparent to the light emitted by luminophor grains L1 to Ln and having a refraction index n1 which is greater than refraction index n0 (n0 approximately equal to 1.5) of substrate 11, and preferably much greater than this refraction index n0 of the substrate (for example no/n1 equal to or less than 0.75). Thus, for example, intermediate layer 15 can be made of titanium oxide $TiO_2$ or else of zinc sulfide ZnS, to present a refraction index n1 on the order of 2.35.

On the other hand, according to another characteristic of the invention, intermediate layer 15 has a thickness E2 which is considerably less than thickness E1 of substrate 11. Relative to substrate 11, intermediate layer 15 constitutes a thin layer which can be made in a simple and low-cost way by evaporation, or else, for example, by an alcoholate immersion method from a titanium alcoholate $T_1(OC_2H_5)_4$. It should be noted that thickness $E_2$ of intermediate layer 15 is not really critical for the operation, the important thing being that it is much smaller than thickness E1 of substrate 11; very satisfactory results have been obtained with values close to a micrometer for thickness E2 of intermediate layer 15. It should be noted that in the figures, the scale of the dimensions is not respected.

Under these conditions, when an electron penetrates luminescent layer 12 and produces in the latter photons p1, p2 (symbolized by their path), these photons can go through the refringent surface formed by the intermediate layer-substrate interface 15-11 only if angles $\phi 1$, $\phi 2$, which their path presents relative to an axis x perpendicular to refringent surface 15-11, are less than critical angle $\phi 11$ whose value is given by refraction indexes n0 and n1 (this critical angle $\phi 11$ being in the example on the order of 38°). Consequently in the example shown, the path of first photon p1 is such that it exhibits an angle $\phi 1$ less than critical angle $\phi 11$, which makes it possible for it to go through intermediate layer-substrate interface 15-11, then to go out of substrate 11 through outside face 14 of the latter if its path forms, with an axis x perpendicular to outside face 14, an angle $\phi 1'$ which is smaller than a critical angle $\phi 0$ given by the indexes of substrate 11 and of the air; critical angle $\phi 0$ in substrate 11 having a value similar to that mentioned in the introductory clause, namely on the order of 43° (outside face 14 represents a refringent surface formed at the interface of substrate 11 and the air).

Assuming that the path of second photon p2 exhibits, relative to perpendicular axis x, an angle which is equal to or greater than critical angle $\phi 11$ at the intermediate layer-substrate interface 15-11, this second photon p2 is reflected at a point referenced c of this interface, to luminescent layer 12 and, if it encounters a luminophor grain L1 to Ln in contact with an upper face 16 of intermediate layer 15, at a point f for example, this photon p2 is rediffused in the direction of substrate 11 into which it can penetrate or not depending on whether its angle of incidence is less than critical angle $\phi 11$ or not.

Thus, if photon p2 encounters a luminophor at point f, this photon can be redistributed to substrate 11, i.e., toward the outside as symbolized by arrows referenced RD; but if there are no luminophors at point f, the second p2 is reflected in the direction of interface 15-11 with an angle which is greater than critical angle $\phi 11$, so that this photon will again be reflected by interface 15-11 in the direction of luminescent layer 12.

If there is considered a distance D2, formed between point f which marks the return of second photon p2 to upper face 16 of intermediate layer 15, and a point 0 where this upper face 16 is in contact with first luminophor L1, point 0 which marks the point where this second photon p2 has been emitted in intermediate layer 15, it is found that for a thickness E2 of intermediate layer 15 on the order of 1 micrometer and for a critical angle $\phi$11 given by refraction indexes n0 and n1 which in the example have values of 2.35 and 1.5 respectively, this distance D2 is on the order of 2 micrometers. This shows that all the photons which penetrate intermediate layer 15 with an angle of incidence which is greater than critical angle $\phi$11 will have the possibility of being redistributed to substrate 11, i.e., in the direction of use, at a lateral distance D2 of 16 micrometers from the point where they have been emitted, while in the prior art the photons which penetrate the substrate at angles which are greater than critical angle $\phi$0 are optionally redistributed to use at a lateral distance of several millimeters from the point where they will have penetrated the substrate.

Also, for the same probability in the two cases that a photon encounters a luminophor grain which assures its redistribution toward the outside, the configuration of the invention induces this redistribution much closer to the point where the light has been emitted. Consequently, the intensity of the halo at a great distance is eliminated, and by combining this with the fact that in intermediate layer 15, the amount of light which undergoes a total reflection is increased, an emission indicatrix which is more concentrated on the axis than in the prior art is obtained, i.e., the intensity of the light emitted along the axis perpendicular to the plane of substrate 11 is reinforced.

Figure 4:
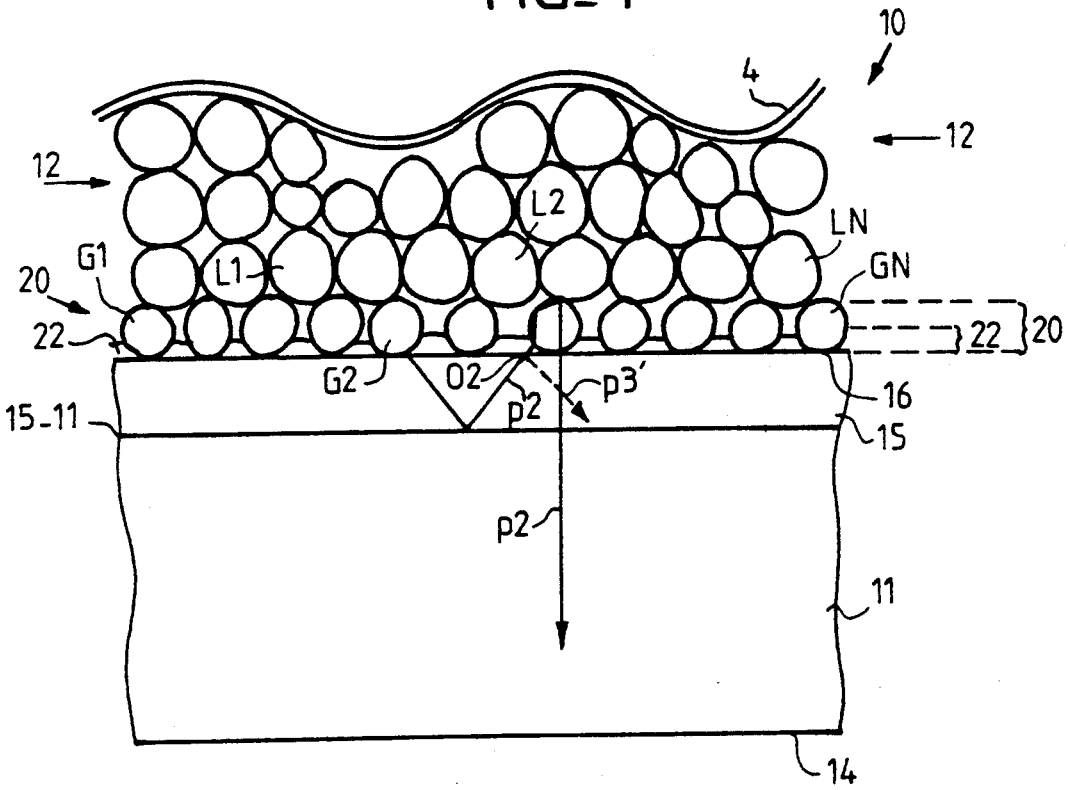
FIG. 4 diagrammatically shows, by a view in section, a preferred version of a screen according to the invention.

FIG. 4 illustrates a preferred version of the invention in which the redistribution efficiency of the light which has been reflected by intermediate layer-substrate interface 15-11 is improved.

For this purpose, a diffusing layer 20 is placed between intermediate layer 15 and luminescent layer 12 or the luminophor layer.

Diffusing layer 20 consists of fine grains G1, G2, . . . , GN which form a compact monolayer and which make it possible to improve the pickup of light greatly after the total reflection by interface 15-11. Actually, the finer and closer grains G1 to GN, the more numerous the points of contact for the recovery of light above intermediate layer 15.

By the term "fine grains," we mean to define grains whose average diameter is less than the average diameter of luminophor grains L1 to Ln of luminescent layer 12. Grains G1 to GN can have an average diameter on the order, for example, of 1 micrometer, and according to another characteristic of the invention, they can be formed advantageously by luminophor grains of the same nature as the luminophor grains of luminescent layer 12, so as to participate also in the production of light.

It should be noted that by the term monolayer, we mean to define a layer whose thickness comprises a single grain, this for the entire surface of the layer (even if in practice some exceptions to this rule can exist locally without degrading the resolution too much).

Screen 10 of the invention can further comprise a connecting layer 22 which is both in contact with upper face 16 of intermediate layer 15 and in contact with grains G1 to GN of diffusing monolayer 20. Connecting layer 22 makes it possible to improve the pickup of light by preventing, by its presence, light rays from undergoing a total reflection at the level of upper face 16 of intermediate layer 15, when these light rays reach this upper face 16 at a point located between two adjacent grains G1 to GN, as is illustrated in FIG. 3 by way of example by a third photon p3. For this purpose, connecting layer 22 has a refraction index n2 which is greater than or equal to refraction index n1 of intermediate layer 15. In this spirit, connecting layer 22 can constitute a dielectric layer made for example of titanium oxide $TiO_2$ by the same method as intermediate layer 15.

Assuming that grains G1 to GN of diffusing layer 20 are also luminophor grains, photon p3 can be emitted in intermediate layer 15 by a grain G2 for example of diffusing layer 20. Photon p3 undergoes a reflection at the level of intermediate layer-substrate interface 15-11, a reflection which reflects it to upper face 16. In the absence of connecting layer 22, photon p3 would be reflected at a point 02 of this upper face 16, as is shown by an arrow in dotted lines referenced p3', except, of course, if point 02 is close enough to a grain G1 to Gn so that the evanescent wave phenomenon can be manifested and make it possible for photon p3 to go out of intermediate layer 15 and to penetrate the grain. With the presence of connecting layer 22, photon p3, even if it arrives at upper face 16 at a point of the latter relatively far from a grain, this photon p3 goes out of intermediate layer 15, and connecting layer 22 picks up this photon and channels it to a third grain G3 for example where it is diffused toward the outside.

Connecting layer 22 also makes it possible to assure a particularly advantageous function of thermal junction in the application to the projection, a function which is useful also if grains G1 to GN of diffusing monolayer 20 are luminophor grains.

Figure 5:
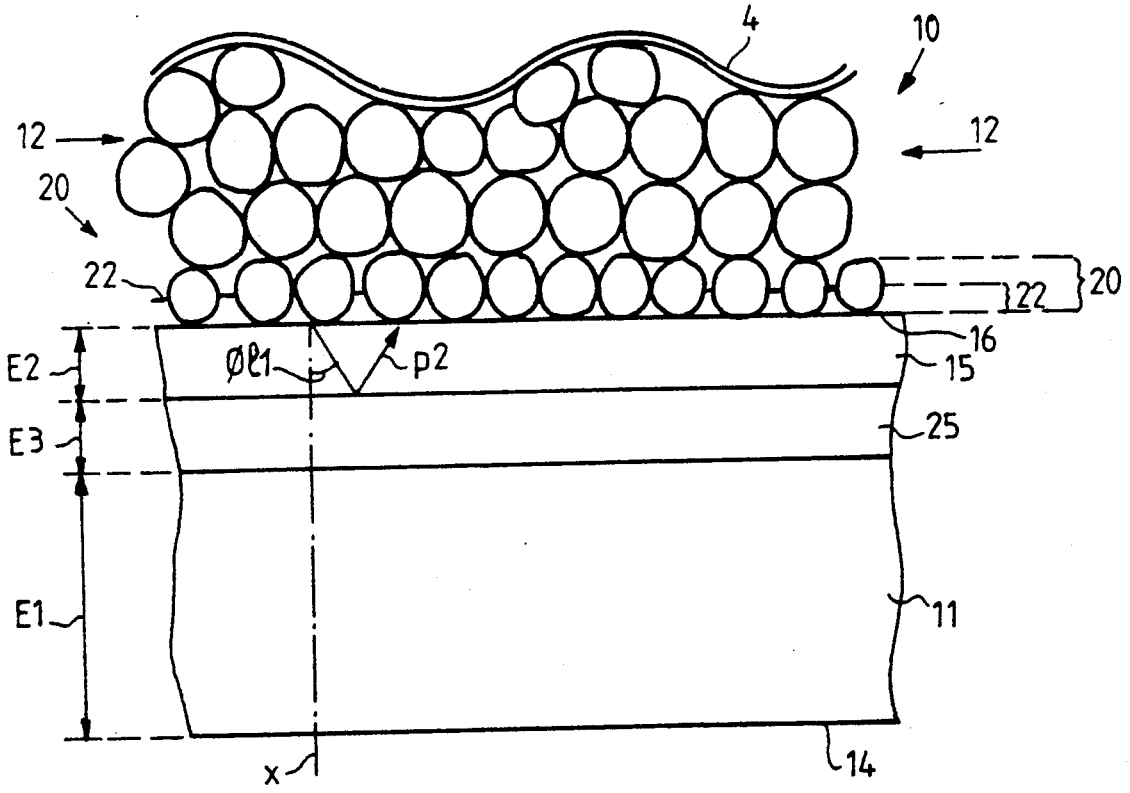
FIG. 5 diagrammatically shows, by a view in section, a variant of the version of the invention shown in FIG. 4.

FIG. 5 shows another version of the invention which makes it possible to reinforce the effect obtained by the insertion of intermediate layer 15.

In this new version of the invention, a second intermediate layer 25 is placed between substrate 11 and first intermediate layer 15.

According to a characteristic of the invention, this second intermediate layer 25 has a refraction index n3 which is less than refraction index n0 of substrate 11. On the other hand, this second intermediate layer 25 has a thickness E3 of the same order of magnitude as thickness E2 of first intermediate layer 15, i.e., close to 1 micrometer; but it should be noted that this thickness E3 is not critical, the important thing being that it is very small in view of thickness El of substrate 11. Second intermediate layer 25 can be made for example of magnesium fluoride $MgF_2$ whose refraction index n3 is on the order of 1.35, by a standard evaporation method.

This new configuration makes it possible to reduce the value of critical angle $\phi$11 in first intermediate layer 15. Thus, for example, to take the same elements as in the example in FIG. 3, critical angle $\phi$1 beyond which photon p2 is reflected to upper face 16 of first intermediate layer 15, this critical angle at a lower value in the case of this new version of the invention than in the case represented in FIG. 3. Actually, assuming that second intermediate layer 25 is of magnesium fluoride $MgF_2$, the new value of critical angle $\phi$11 is on the order of 35°. This is due to the fact that the refraction index difference between index n1 of first intermediate layer 15 and index n3 of second intermediate layer 25 is larger than the index difference between intermediate layer 15 and substrate 11 shown in FIG. 3. As has been stated above, this reinforces the effects produced by intermediate layer 15 and makes it possible to increase the light emission indicatrix to the maximum and thus to obtain the maximum light gain by a concentration of the angle (not shown) of the light indicatrix.

It is possible to obtain a still smaller refraction index n3 for second intermediate layer 25 if this second intermediate layer 25 consists of a microporous layer. Thus, for example, second intermediate layer 25 can be a microporous layer of silicon oxide $SiO_2$ whose refraction index can be close to 1.25, which makes it possible to obtain a still smaller critical angle $\phi$11 on the order of 32°. This second intermediate layer formed by a porous layer of silicon oxide can be deposited on substrate 11 in a way which is standard in itself, for example by an ultracentrifuging method whose use is easy or else by a wet densification process which leads to obtaining a deposit whose degree of porosity depends on conditions of use.

It should be noted that the nature of materials able to form the various layers, namely first intermediate layer 15, second intermediate layer 25, diffusing layer 20, connecting layer 22, the nature of these materials is indicated by way of example not at all limiting and other materials can be chosen in particular as a function of the color of the light. Thus, for example, the layers whose refraction index is high can be $TiO_2$, ZnS, $Ta_2O_5$, $CeO_2$, $Fe_2O_3$ (n=2.6), the latter being particularly advantageous in the case of the orange-red color range. The use of such materials, according to the concept of the invention, makes it possible to obtain luminance gains on the order of 40%, for the green and the blue in particular, and greater than 40% for the red in the case of use of $Fe_2O_3$.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A cathodoluminescent screen for cathode-ray tubes, comprising:

a substrate having a first thickness and a first refraction index and a first angle of total internal reflection relative to the surface normal direction, at the substrate air interface;

a luminescent layer attached to said substrate which produces light when bombarded by electrons;

an optical filtering mans for transmitting light luminescent layer into said substrate, independent of the wavelength of the light, and for reflecting from said substrate all light from the luminescent layer propagating at an angle which is greater than said second angle, independent of the wavelength of the light, said second angle being less than said first angle, the optical filtering means including, a first intermediate layer disposed between said luminescent layer and said substrate, said first intermediate layer having a second thickness which is considerably less than said first thickness of said substrate and a second refraction index that is greater than said first refraction index of said substrate.

2. A cathodoluminescent screen according to claim 1, further comprising:

a diffusing layer formed by a plurality of grains between said luminescent layer and said first intermediate layer.

3. A cathodoluminescent screen according to claim 2, wherein said diffusing layer is a monolayer.

4. A cathodoluminescent screen according to claim 2, wherein said grains are luminophor grains.

5. A cathodoluminescent screen according to claim 2, which further comprises:

a connecting layer formed on an upper face of said first intermediate layer opposite said substrate, said grains of the diffusing layer being partially coated in said connecting layer, said connecting layer having a refraction index whose value is at least equal to said second refraction index of said first intermediate layer.

6. A cathodoluminescent screen according to claim 1, wherein a second intermediate layer is between said first intermediate layer and said substrate, said second intermediate layer having a lower refraction index value than said first refraction index value of said substrate.

7. A cathodoluminescent screen according to claim 6, wherein said second intermediate layer consists of a microporous layer.

8. A cathodoluminescent screen according to claim 7, wherein said second intermediate layer is a microporous layer of silicon oxide $SiO_2$.

9. A cathodoluminescent screen according to claim 6, wherein said second intermediate layer is magnesium fluoride $MgF_2$.

10. A cathodoluminescent screen according to claim 1, wherein said first intermediate layer is titanium oxide $TiO_2$.

11. A cathodoluminescent screen according to claim 1, wherein said first intermediate layer is zinc sulfide ZnS.

12. A cathodoluminescent screen according to any one of the preceding claims, wherein the ratio of said first refraction index of said substrate to said second refraction index of said first intermediate layer is at most 0.75.

* * * * *